United States Patent [19]

Bohannon, Jr. et al.

[11] Patent Number: 4,595,431

[45] Date of Patent: Jun. 17, 1986

[54] METHODS OF AND APPARATUS FOR APPLYING A WATERPROOFING MATERIAL TO A CABLE CORE WRAP

[75] Inventors: William D. Bohannon, Jr., Lawrenceville; Alfred S. Hamilton; Danny E. West, both of Norcross, all of Ga.

[73] Assignee: AT&T Technologies, Inc., Berkeley Heights, N.J.

[21] Appl. No.: 695,337

[22] Filed: Jan. 28, 1985

[51] Int. Cl.[4] ..... H01B 13/10

[52] U.S. Cl. ..... 156/54; 29/745; 29/825; 156/56; 156/203; 156/244.23; 156/466; 174/102 C; 174/102 R; 174/102 D; 174/107

[58] Field of Search ..... 29/825, 745; 156/50-54, 56, 203, 244.23, 466, 578; 174/23 C, 23 R, 102 D, 105 R, 106 D, 107; 425/113

[56] References Cited

U.S. PATENT DOCUMENTS

| | | | |
|---|---|---|---|
| 2,922,204 | 1/1960 | Mason . | |
| 3,011,933 | 12/1961 | Barnes et al. | 156/201 |
| 3,629,489 | 12/1971 | Jachimowicz et al. | 174/107 |
| 3,638,306 | 2/1972 | Padowicz | 174/107 X |
| 3,703,034 | 11/1972 | Eilhardt et al. | 156/54 X |
| 3,717,716 | 2/1973 | Biskeborn et al. | 174/25 R |
| 3,785,048 | 1/1974 | Petersen | 174/105 R X |
| 4,176,240 | 11/1979 | Sabia | 174/23 C |
| 4,308,662 | 1/1982 | Bohannon | 29/828 |
| 4,404,720 | 9/1983 | Bohannon | 29/33 E |
| 4,477,298 | 10/1984 | Bohannon et al. | 156/54 |
| 4,482,413 | 11/1984 | Bohannon et al. | 156/54 |
| 4,518,034 | 5/1985 | Vokey | 156/54 |

*Primary Examiner*—Robert A. Dawson
*Attorney, Agent, or Firm*—E. W. Somers

[57] ABSTRACT

Methods and apparatus are provided for controlling the quantity and distribution of a waterproofing material (26) on an advancing strip (76) of plastic material which is wrapped subsequently about an advancing cable core (22) to form a core wrap. When the plastic strip is wrapped about the core, which has been filled with the same waterproofing material, the waterproofing material on the strip fills any spaces between the strip and the core, between the strip and an inner metallic shield (31) and a longitudinal overlapped seam of the core wrap. In another cable structure, a controlled amount of waterproofing material is disposed along a longitudinal edge portion of the advancing strip of plastic material to insure a sealed seam when the strip is wrapped about the core.

16 Claims, 10 Drawing Figures

METHODS OF AND APPARATUS FOR APPLYING A WATERPROOFING MATERIAL TO A CABLE CORE WRAP

TECHNICAL FIELD

This invention relates to methods of and apparatus for applying a waterproofing material to a cable core wrap. More particularly, it relates to methods of and apparatus for controllably applying a waterproofing material to a strip of plastic material which encloses a filled cable core in a sheath arrangement.

BACKGROUND OF THE INVENTION

In the manufacture of a communications cable, a core comprising a plurality of insulated conductors is enclosed in a strip of plastic material, which is referred to as a core wrap. Subsequently, the core wrap is enclosed by other components of a sheath system such as, for example, a metallic shield and a plastic jacket. The core wrap insulates the core from the metallic shield which is designed to protect the cable core from electrical disturbances. The core wrap and the shield, which often times is corrugated, are formed from continuous strips which are wrapped longitudinally with overlapped seams about an advancing cable core.

In order to preserve the transmission qualities of a communications cable, it becomes necessary to prevent the ingress of moisture into the multiconductor core of the cable. This may be accomplished by introducing a pressurized gas. In an increasingly popular technique, the cable core is filled with a waterproofing material and wrapped with a strip of plastic material after which a metallic tape is wrapped about the core to form a shield and has its outer surface flooded with another waterproofing material. Typically, a waterproofing material such as one designated Flexgel TM filling material, is used to fill the core and an atactic material is used to flood the shield. Flexgel is a trademark of AT&T Technologies, Inc. Such a filling material is disclosed in U.S. Pat. No. 4,176,240 which issued on Nov. 27, 1979 in the name of Ralph Sabia. The last-described process produces what is referred to as a filled cable and avoids the necessity of pressurizing the cable.

For some filled cables, a dual metallic shield system is used. An inner shield which is made of a material having a relatively high electrical conductivity is used to dissipate stray electomagnetic currents and lightning. Formed about the inner shield which may comprise aluminum, for example, and which has its outer surface flooded with an atactic material is an outer shield which is made of a material such as steel having a relatively high modulus of elasticity. The outer shield provides suitable mechanical strength for the cable. Such a cable which also includes a plastic jacket is commonly referred to as an ASP cable. Each of the shields typically is formed with a longitudinal seam which at least for the outer shield usually is overlapped.

It is not uncommon to bond the plastic jacket to the outer surface of the outer shield. By bonding the plastic jacket to the outer shield, which generally is corrugated, it has been found that the resistance of the cable to moisture diffusion is increased substantially. Also, it provides mechanical strength to resist buckling, crushing and scuffing. Further, if the jacket is not bonded to an adjacent shield, the pulling of the cable into an underground duct more often than not will cause a separation of the jacket from the shield.

There is a need to seal the longitudinal overlapped seam of the outer shield. The sealing of the seam further reduces the probability of moisture ingress. Secondly, it prevents the escape of waterproofing material from the interface between the inner and outer shields to the external surface of the outer shield. Should any such material become deposited on the outer surface of the outer shield, bonding of the jacket to the shield is impaired. As a result, the jacket may exhibit irregularities or easily become separated from the outer shield when the cable is pulled into a duct. Further, a sealed seam is helpful in preventing the overlying edge portion of the outer shield from protruding into the jacket and weakening the plastic.

In order to insure that moisture is kept out of the core, the core wrap also should be provided with a waterproofing material. The inner surface of the core wrap material contacts waterproofing material inasmuch as it is wrapped about the filled core. As the strip of plastic is wrapped about the core, the waterproofing material on the inner surface tends to be flowed toward the seam to seal it. However, it would not be wise to depend on portions of the core filling material to be flowed into the seam area as that could result in voids between the core and the inner surface of the core wrap. Therefore, a technique is required which will provide the inner surface of the core wrap with sufficient waterproofing material to seal the seam. Also, the application of the waterproofing material to the outer surface of the strip of plastic material must be accomplished in a controlled manner. Otherwise, for example, some of the waterproofing material on the outer surface of the core wrap could seep through the seam of the aluminum shield which is wrapped subsequently or simultaneously about the core and contaminate the atactic material which is applied to the outer surface of the aluminum shield.

The prior art appears to be devoid of methods and apparatus which are suitable for controllably applying a waterproofing material to an advancing strip of plastic material which is destined to enclose a cable core. What is needed are methods and apparatus for applying waterproofing material to a plastic strip in any one of several sheath arrangements.

SUMMARY OF THE INVENTION

The foregoing problems have been overcome by the methods and apparatus of this invention. In a method of applying waterproofing material to a strip of plastic material which is used to enclose a cable core, the core is advanced along a path of travel. The strip of plastic material is advanced along a path which is juxtaposed to the core and a waterproofing material in liquid phase is applied to at least one major surface of the strip. A metering member is disposed transversely across the one major surface of the strip. A portion of the advancing strip is held spaced from the metering member to control the quantity and distribution of waterproofing material that remains on the one major surface as the strip is advanced past the metering member. Then the strip is wrapped about the advancing core to form a cover having a longitudinal overlapped seam with the quantity and distribution of waterproofing material remaining on the one major surface being sufficient to cause waterproofing material to become disposed in the seam.

In a preferred embodiment, along the path of travel, the strip of plastic material is moved into and out of a tank which contains a liquid waterproofing material. In the tank, one major surface of the strip is covered with the waterproofing material as is the other major surface, which is destined to become oriented outwardly when the strip is wrapped about the core. The strip is engaged in a manner and the waterproofing material is sufficiently viscous to cause the waterproofing material on the other major surface to become disposed in a plurality of longitudinally extending troughs and ridges. Subsequently, the one major surface is advanced past a metering member as the strip is advanced out of the tank. The metering member is held in a predetermined position relative to the advancing strip to control the quantity and distribution of the waterproofing material on the one major surface.

An apparatus for applying a controlled amount of waterproofing material to each major surface of an advancing strip of plastic material includes a tank which contains the waterproofing material and through which the strip is advanced. During the application of waterproofing material to the strip, the longitudinal edge surfaces of the strip which interconect the major surfaces are oriented vertically. The apparatus also includes a grooved roller which engages a lower surface of the strip and which causes the waterproofing material thereon to be disposed in a plurality of troughs and ridges. A rod is adapted to engage a center portion of the strip as it is advanced past a metering member and is capable of being adjusted to control the amount and distribution of waterproofng material on the upper surface of the strip.

BRIEF DESCRIPTION OF THE DRAWINGS

Other features of the present invention will be more readily understood from the following detailed description of specific embodiments thereof when read in conjunction with the accompanying drawings, in which.

DETAILED DESCRIPTION

Figure 1:
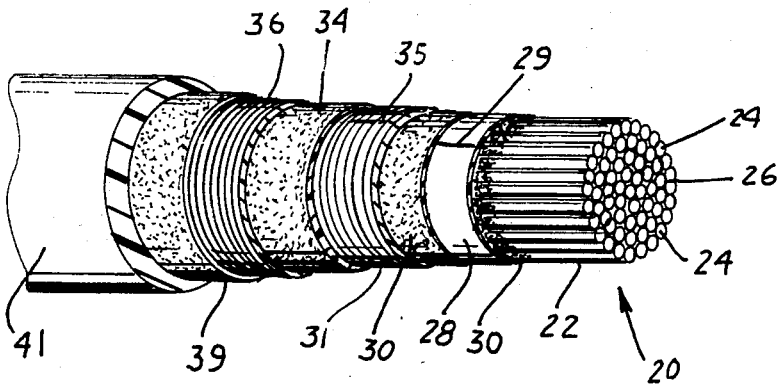
FIG. 1 is a perspective view of a cable which is made in accordance with the methods and apparatus of this invention.
Figure 2:
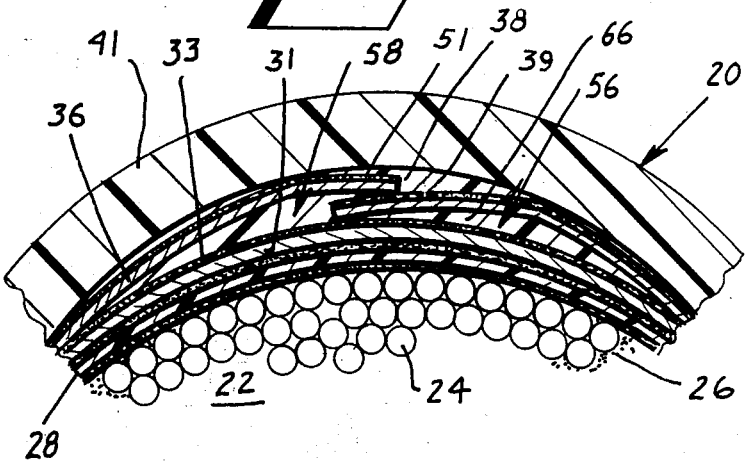
FIG. 2 is an end view of a portion of the cable of FIG. 1.

Referring now to FIGS. 1 and 2 there is shown a cable which is designated generally by the numeral 20 and which is made in accordance with this invention. The cable 20 which is referred to as a bonded ASP cable includes a core 22 which comprises a plurality of individually insulated conductors 24—24. In order to protect the cable from moisture, the interstices of the core 22 are filled with a waterproofing material 26. The waterproofing material may be Flexgel TM filling compound, for example, disclosed in priorly identified U.S. Pat. No. 4,176,240 which is incorporated by reference hereinto.

The core 22 is enclosed by a plurality of coverings beginning with a core wrap 28 which is made from a strip of plastic material such as Mylar ® plastic. The core wrap 28 is wrapped longitudinally about the core 22 with an overlapped seam 29. In order to eliminate pockets in which moisture may collect, each major surface of the core wrap 28 in a preferred embodiment is provided with a layer 30 (see FIG. 1) of the waterproofng material 26 which is used to fill the core 22.

Covering the core wrap 28 is a metallic inner shield 31. Preferably, the inner shield 31, which is used to dissipate stray currents and to provide protection from lightning, is made from a corrugated aluminum tape. The corrugations on an outer surface 33 of the inner shield 31 are filled, preferably with a layer 34 of another waterproofing material such as an atactic polypropylene material which is a byproduct of the manufacture of crystalline polypropylene. The inner shield 31 is wrapped about the core wrap 28 with a longitudinal overlapped seam 35. Inasmuch as the outer surface of the core wrap 28 is provided with a waterproofing material, the corrugations on the inner surface of the shield 31 become filled substantially with that material.

The overlapped seam 35 of the inner shield provides several functions. It provides more effective shielding than a non-overlapped seam, it avoids the forming of a gap along which water can travel, and it facilitates the introduction of waterproofing material between the edge portions. Although the overlapped seam is preferred, there may be instances where an open or butted longitudinal seam could be used.

Covering the inner shield 31 is a metallic outer shield 36 which provides mechanical strength for the cable 20. The outer shield 36 which is corrugated and which is made of a metallic material having a relatively high modulus of elasticity has a longitudinal overlapped seam 38. Further, at least the outer surface of the outer shield 36 is coated with a layer 39 of adhesive material such as, for example, an acrylic acid copolymer material. This layer of adhesive material is used to cause a subsequently applied jacket 41 to become bonded to the outer shield. For a preferred embodiment of an adhesive coating system which bonds suitably to the metallic outer shield and to the plastic material of the jacket 41, see application Ser. No. 626,079 which was filed on June 29, 1984 in the names of W. D. Bohannon, Jr. et al and which is incorporated by reference hereinto.

As can be seen in FIG. 2, the overlapped seam 38 of the outer shield 36 is formed specially with an overlying downturned edge portion 51. The downturned edge portion 51 engages an inner edge portion of the outer shield 36 and is formed in accordance with methods which are disclosed and claimed in U.S. Pat. No. 4,308,662 which issued on Jan. 5, 1982 in the name of W. D. Bohannon, Jr. Because it is downturned, the edge porton 51 does not protrude outwardly from the core 22 and into the jacket plastic. Also, it should be noted that in a preferred embodiment the overlapped seam 38 of the outer shield 36 is displaced from the overlapped seam 35 of the inner shield 31 in a direction circumferentially of the core.

The outer shield 36 which has higher strength properties than the inner shield 31 does not conform to the contour of the inner shield in the vicinity of the seam 38. As a result, cavities 56 and 58 (see FIG. 2) are formed between the outer shield and the inner shield. These cavities which extend longitudinally along the cable 20 provide paths along which moisture can travel. To protect the cable core from moisture, these cavities are filled with a waterproofing material as described in above-identified application Ser. No. 626,079. The cable 20 is formed so that the waterproofing material in the cavities 56 and 58, which may be a thermoplastic sealant material, forms a gasket designated by the numeral 66. A portion of the sealant material is disposed between the overlapping edge portions of the outer shield 36 and bonds together those edge portions. The arrangement is such that waterproofing material 34 does not flow through the seam 38 and coat the outer surface of the outer shield 36. If it did, the bond, if any, between the jacket 41 and the outer shield 36 would be insufficient to prevent separation of the jacket from the outer shield during pull-in operations in the field.

In bonded ASP cable, it is desirable to apply waterproofing material between the core wrap 28 and the aluminum shield 31 and to insure that substantially no voids exist between the core 22 and the core wrap. This is accomplished by applying the waterproofng material 26 to both sides of the strip material destined to become the core wrap and then feeding the core wrap material and the aluminum tape destined to become the inner shield to a forming die where they are formed simultaneously about the advancing filled core. See U.S. Pat. No. 4,482,213 which issued on Nov. 13, 1984 in the names of W. D. Bohannon, Jr. and A. S. Hamilton and which is incorporated by reference hereinto. Moreover, the waterproofing material which is applied to what is destined to become the outer surface of the core wrap 28 is applied in a particular manner to facilitate its filling the corrugations of the aluminum shield 31 which encloses the core wrap.

It becomes important to insure that a suitable amount of the waterproofing material be disposed on each surface of the plastic core wrap 28 and that it be distributed to insure that the above-mentioned objectives are met. If the amount is insufficient or if the distribution is not as desired, voids may be created between the core wrap 28 and the core 22 and/or between the core wrap and the inner shield 31. These voids provide unwanted paths along which moisture can travel. The amount on the outer surface of the core wrap 28 is particularly important inasmuch as the outer surface is contiguous to a corrugated metallic material. As a result, the waterproofing material on the outer surface of the core wrap must be sufficient to fill the corrugations. On the other hand, if too much waterproofing material is applied to the outer surface, irregularities may appear in the core wrap 28 and waterproofing material may seep through the overlapped seam of the inner shield 31 and contaminate the atactic polypropylene 34 thereon.

Figure 3:
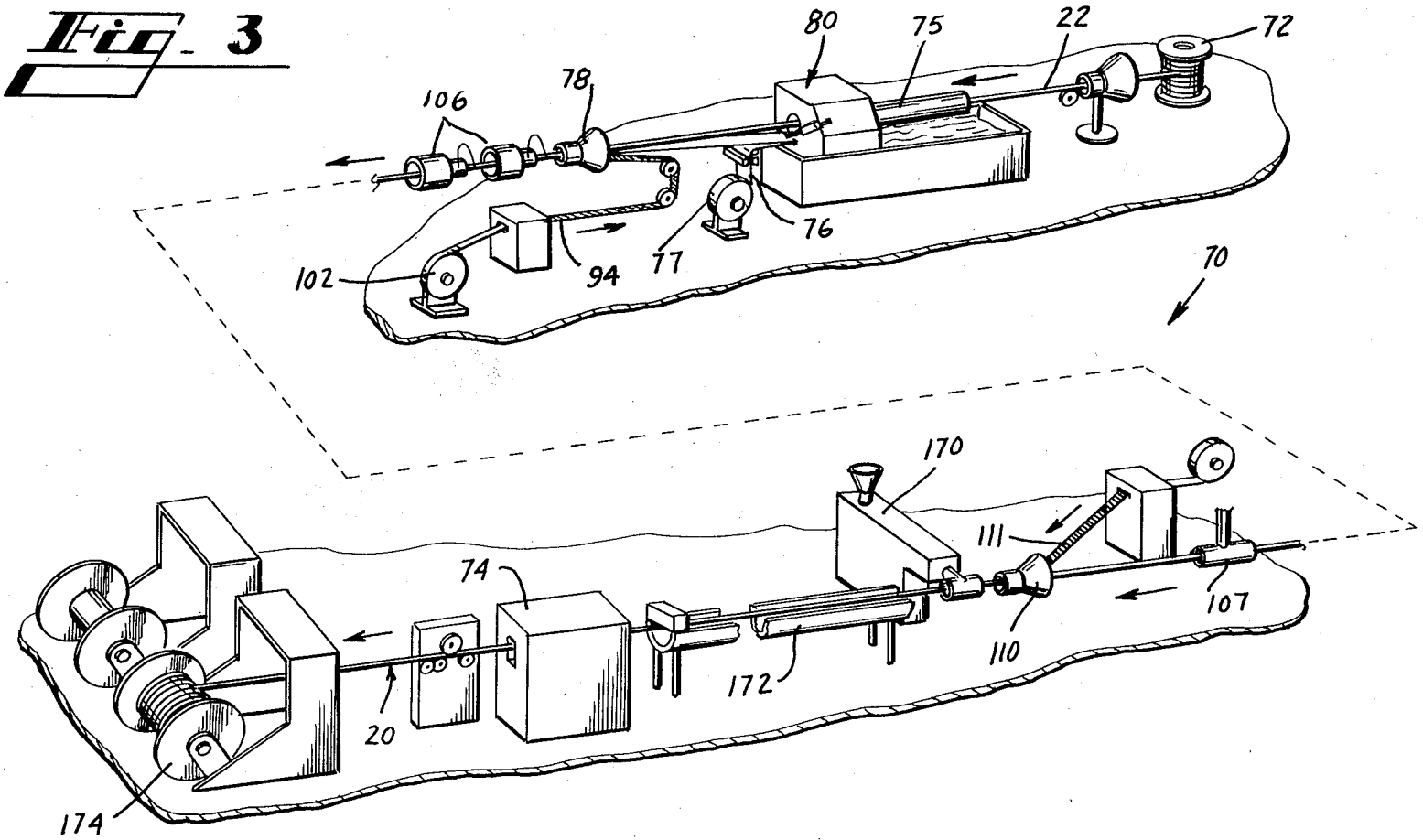
FIG. 3 is a schematic view of apparatus for making the cable of FIG. 1.

Going now to FIG. 3, there is shown a schematic view of apparatus designated generally by the numeral 70 for making the cable 20. The apparatus includes a supply reel 72 of the core 22 which is caused to be advanced by a capstan 74 through a filling chamber 75 which is used to fill the interstices of the core with the waterproofing material 26 such as Flexgel filling material. The filled core 22 is wrapped with a strip 76 of plastic material such as the Mylar plastic which is advanced from a supply 77. Before the plastic strip 76 is formed into the core wrap 28 by a device 78, both major surfaces are provided with a waterproofing material such as, for example, the Flexgel filling material 26.

Figure 4:
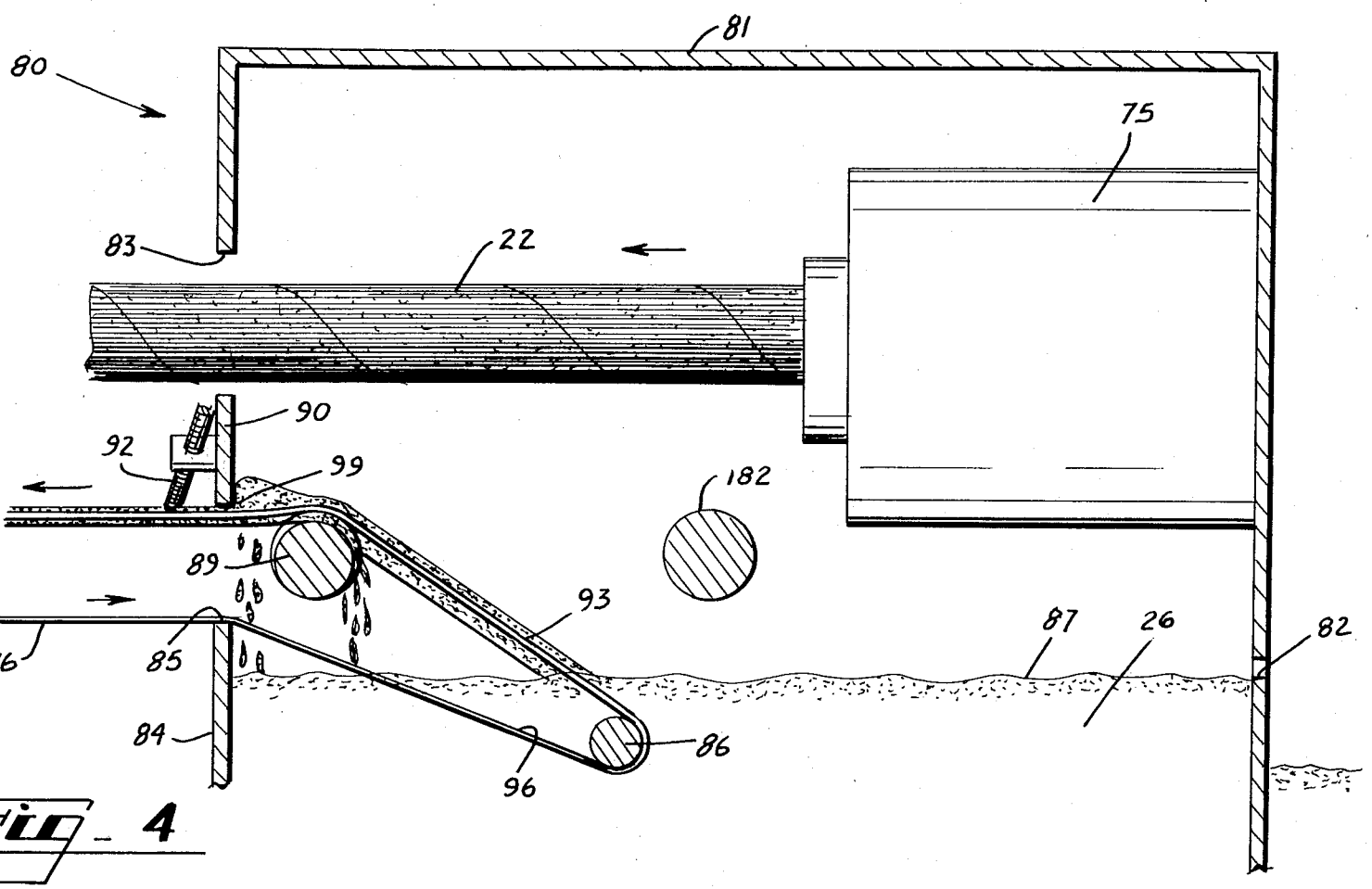
FIG. 4 is an enlarged elevational view of a portion of the apparatus of FIG. 3.
Figure 5:
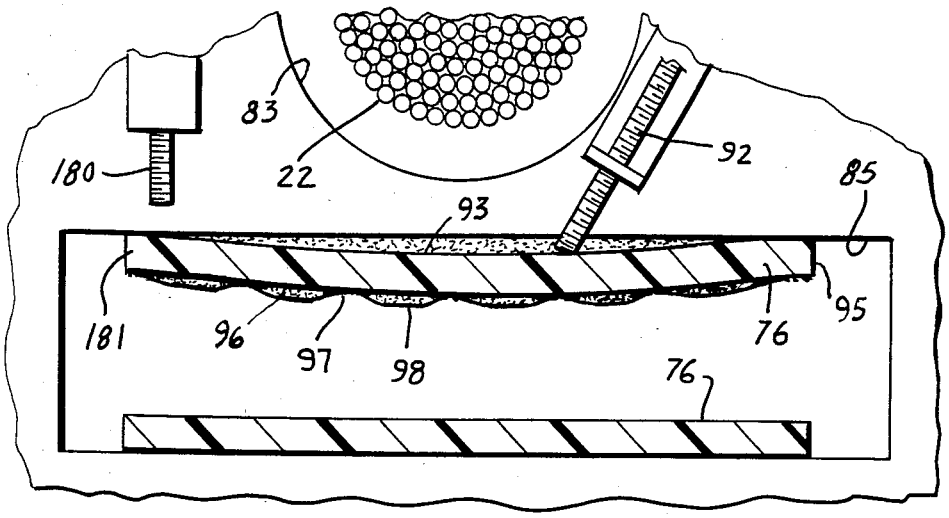
FIG. 5 is an end view of the apparatus of FIG. 4.

The waterproofing material 26 is applied to both surfaces of the strip 76 of plastic material with an apparatus 80 which is shown in FIGS. 3-5. Waterproofing material 26 in a liquid phase from the filling chamber 75 is carried forward and it together with drippings from the core 22 provide a supply to an enclosed tank 81 having a weir 82 at one end thereof. The weir 82 functions to maintain the waterproofing material 26 in the tank 81 at a predetermined level. The temperature of the waterproofing material 26 in the filling chamber 75 and in the tank 81 is about 215° F. and is such that the waterproofing material is maintained in a liquid phase with a maximum viscosity in the range of about 39 cps. The cable core 22 is advanced through an opening 83 in a wall of the tank 81.

Figure 6:
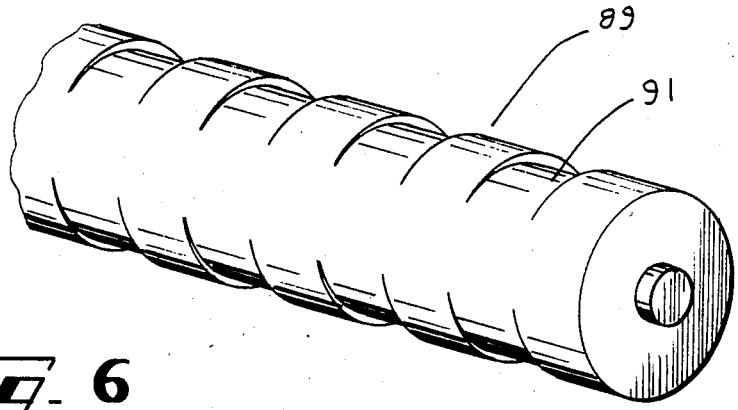
FIG. 6 is an enlarged view of a grooved roller which is shown in FIG. 4.

The plastic strip 76 which is destined to become the core wrap 22 is advanced past a lower wall 84 which defines an opening 85 in the tank 81 and around a guide roller 86 which is positioned below a free surface 87 of the waterproofing material 26. From the guide roller 86, the strip 76 is moved in an opposite direction past a stationary application roller 89 having grooves 91—91 (see FIG. 6) and then in engagement with an upper wall 90 of the opening 85. As the strip 76 is advanced out of the tank 81, it passes below an end of an adjustable rod 92 (see also FIG. 5) which is used to control the residual quantity and distribution of waterproofing material on an upper major surface 93 of the strip. Afterwards, the strip 76 is advanced into juxtaposition with an aluminum tape 94 (see FIG. 3) which is corrugated and the two are wrapped simultaneously about the core.

As the plastic strip 76 is moved through the tank 81, waterproofing material 26 is applied to both sides thereof. The amount of the waterproofing material on the major surfaces of the strip is altered by the grooved roller 89 and by the cooperation of the adjustable rod 92 with the upper wall 90 which serves as a metering member. The metering member is disposed transversely across the width of the strip 76.

Figure 7:
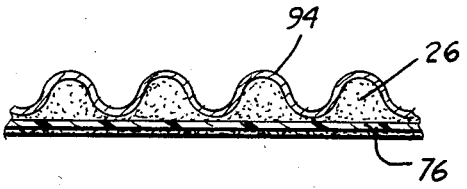
FIG. 7 is a detail view of an outer surface of a strip of plastic material having waterproofing material disposed thereon and engaged with a corrugated metallic tape which provides a shield of the cable.

The grooved roller 89 controls the amount of waterproofing material on a major surface 96 of the plastic strip 76 which is connected to the major surface 93 through a longitudinal edge surface 95 (see FIG. 5) and which is destined to be oriented outwardly when the plastic strip is wrapped about the core 22. It causes the waterproofing material 26 on the underside of the advancing strip 76 which is to become the outer surface of the core wrap to be disposed in a plurality of parallel troughs 97—97 and stripes or ridges 98—98 (see FIG. 5). This facilitates the filling of the corrugations of the metallic tape when the aluminum tape 94 is wrapped about the plastic core wrap (see FIG. 7).

Another feature of the roller 89 is that, in a preferred embodiment, the grooves 91—91 of the roller are of a variable depth about the periphery of the roller. As a result, the depth of the troughs and the height of the ridges 98—98 of the waterproofing material may be controlled. The depth of the troughs 97—97 is adjusted by adjusting the circular orientation of the roller 89. Not only does the variable depth groove arrangement allow ocntrol of the stripes of waterproofing material 26 but also it has been found that this configuration of the coating is far easier to control than attempting to provide a uniform coating across the entire width of the strip 76 of plastic material. As should be apparent, with the strip 76 of plastic material being moved across the roller 89, but for the grooves 91—91, much of the waterproofing material applied to the underside of the strip in the tank 81 would be wiped off.

After the strip 76 passes the grooved roller 89, it passes below the depending wall 90 which defines the opening 85 in the tank 81 and which serves to meter the waterproofing material on the tape. An edge surface 99 (see FIG. 4) which may engage the strip 76 acts to wipe the waterproofing material and provide a uniform coating thereof across the upper major surface 93 of the strip.

It should be observed from the drawings that the edge surface 99 of the depending wall portion 90 is below a horizontal plane through the top of the grooved roller 89. Because of this arrangement, the strip 76 is held biased against the edge surface 99 of the depending wall portion 90. Without the use of the adjustable rod 92, the edge surface 99 would wipe the strip 76 across the entire width thereof and cause only a relatively thin layer of waterproofing material to remain on the strip as it is moved past the wall 90.

The adjustable rod 92 cooperates with the wall 90 to control the quantity and the distribution of waterproofing material on the upper surface 93 of the advancing strip 76 (see FIG. 5). The degree of wiping action by the depending wall surface 99 is capable of being adjusted by the rod 92. An end of the rod 92 is aligned substantially with a center portion of the advancing plastic strip 76. By turning the rod 92 in one direction, the rod is caused to be moved in a direction toward the strip 76 to cause an end of the rod to engage the strip and urge its center downwardly. As a result, the center portion of the strip 76 is spaced from the depending wall 90 with edge portions of the strip being substantially in engagement with the wall. The amount of spacing is a function of how far the rod 92 is turned toward the advancing strip 76.

As the center portion of the strip 76 is moved from the depending wall 90, the amount of waterproofing material 26 carried by each successive increment of the strip increases. This of course provides additional material so that when the strip 76 is wrapped longitudinally about the cable core 22, sufficient waterproofing material is available to cause the overlapped seam of the strip to be sealed. This contrasts with prior art attempts to seal the seam which depended on surplus material on the surface of the core 22 to flow to the vicinity of the seam. This of course could remove wateproofing material from needed areas and result in a less than satisfactory waterproofed cable. Also, some waterproofing materials such as Flexgel filling compound do not tend to flow so freely, particularly upon contacting the relatively cool advancing strip of plastic material. With the methods of this invention, surplus material for seam sealing is provided without affecting the filled core.

At the beginning of a cable run, line temperatures are not altogether in control. As a result, excess waterproofing material 26, which is very hot, drops from the advancing cable core 22 onto the plastic strip 76 outside the enclosed tank 81. This in itself generally provides a sufficient quantity of waterproofing material on the upper surface of the stip 76. Accordingly, at start-up, the adjustable rod 92 is generally out of engagement with the strip 76 and the edge surface of the depending wall wipes the upper surface of the strip and leaves only a relatively thin film thereon. As the temperature comes under control, less waterproofing material drops and the rod 92 must be turned to deflect the strip.

An additional feature of the invention is the wall 84 which is aligned with the upper depending wall of the opening. The wall 84 holds the advancing strip above the free surface 87 of the liquid waterproofing material. In this way, any drippings from the cable core 22 onto the strip inside the enclosure fall onto a downwardly sloping strip. This causes these drippings to flow into the tank 81.

Outside the tank 81, the tape 94 of aluminum is advanced from a supply 102, corrugated and formed into the tubular inner shield 31 simultaneously with the strip 76 being wrapped about the core 22. This may be accomplished with the methods and apparatus disclosed in priorly mentioned U.S. Pat. No. 4,482,413. The tape 94 and the strip 76 are formed by the device 78 to have the longitudinal overlapped seam 35 and 29. As the tape 94 is formed into the shield 31, the corrugations on the inner surface thereof become filled with the waterproofing material with which the core wrap 28 had been flooded (see FIG. 7). In time, the waterproofing material 26 cools and assumes a solid phase. Then the shielded core 22 is moved through binders 106—106 and a chamber 107 which causes a layer of waterproofing material such as atactic polypropylene to be applied over the outer surface of the inner shield 31. An atactic polypropylene is used because of its relatively high melting point compared to that of the Flexgel filling material. This becomes important during the extrusion of the jacket material in that is resists melting and unwanted displacement from the heat of extrusion.

The shielded core then is moved through an apparatus 110 (see FIG. 3) such as that disclosed and claimed in U.S. Pat. No. 4,404,720 which issued on Sept. 20, 1983 in the name of W. D. Bohannon, Jr. and which is incorporated by reference hereinto. Therein, a corrugated tape 111 of steel is formed into the outer shield 36 about the shielded core. This is done in a manner to cause the overlying edge portion 51 of the outer shield to be turned inwardly toward the longitudinal axis of the core and into engagement with the outer surface of the outer shield.

Figure 8:
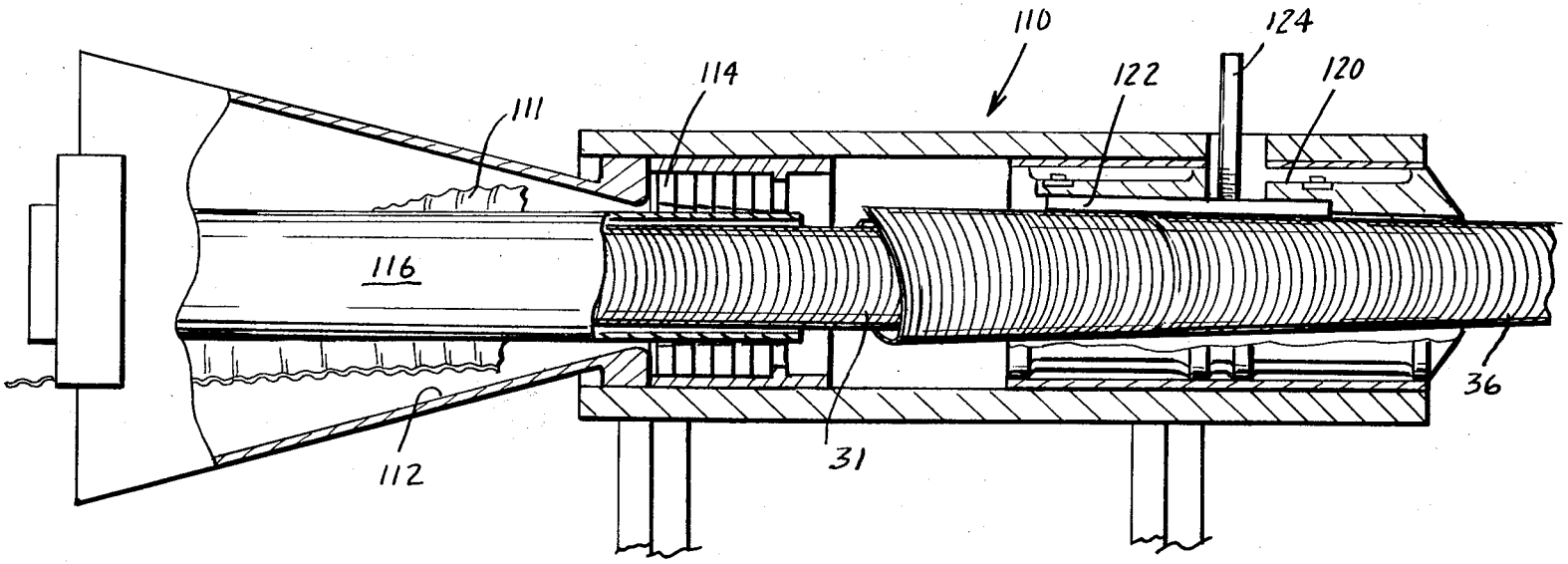
FIG. 8 is an elevational view of another portion of the apparatus of FIG. 3.

The apparatus 110 whch is used to form the steel tape 111 into the outer shield 36 is shown in FIG. 8. It includes a conically shaped portion 112 and a plurality of plates 114—114 having progressively decreasing openings to cause the steel tape to become partially tubular about a centrally disposed guide tube 116.

Afterwards, the partially formed steel tape 111 is moved through a tool designated generally by the numeral 120. Portions of the tool 120 used to guide the longitudinal edge portions of the steel tape 111 and to cause them to be formed into the configuration shown in FIG. 2. As such, the tool 120 includes a key 122 which includes guideways (not shown). The longitudinal edge portions of the partially formed steel tape are moved along the guideways which in accordance with the priorly mentioned Bohannon, Jr. U.S. Pat. No. 4,404,720 causes them to be formed into an overlapping relationship as shown in FIG. 2.

The tool 120 also includes provisions for introducing sealant material into engagement with portions of the cable as the seam 38 of the outer shield is being formed. In order to accomplish this, the tool 120 includes a slot (not shown) which extends from an outer portion thereof inwardly toward the core. The slot is connected through a conduit 124 to a source of the sealant material.

Also, the tool 110 is provided with a deflector plate (not shown) which is adjacent to the inner shield 31. The deflector plate which is effective to apply forces to the inner shield 31, creating a void into which the sealant material is introduced, is disclosed in hereinbefore identified application Ser. No. 626,079. The sealant material flows in opposite directions circumferentially of the core 22. Then as the longitudinal edge portions of the steel tape 111 are brought into overlapping relation with each other, the sealant material is compressed between them and the inner shield 31. This causes the material to fill the cavities 56 and 58 formed between the two shields.

Beyond the vicinity of the seam 38, the outer shield 36 conforms generally to the contour of the inner shield 31. As a result, the flow path for the sealant material which provides the gasket 66 decreases in size as the material flows away from the seam 38. Further, because the waterproofing material 34 already in place on the outer surface of the inner shield is at a temperature of about 220° F., the sealant material, which is at a temperature of about 350° F., is caused to set up as it travels circumferentially in contact with the cooler material on the inner shield.

Afterwards, the shield cable core is advanced through an extruder 170 which causes a plastic material to be applied over the outer shield 36 to form the jacket 41. As will be recalled, the outer surface of the outer shield 36 had been precoated with a suitable adhesive material. This causes the plastic material which forms the jacket 41 to become bonded to the outer shield 36. Then the jacket plastic is cooled in a trough 172 and taken up on a reel 174.

In another cable construction, the strip 76 of plastic material is generally formed about the core 22 well ahead of the aluminum inner shield 31. This is done because both major surfaces of the inner shield 31, but only the outer surface of the plastic tape, are flooded with an atactic material. It is desirable to flood the aluminum tape with the atactic material just prior to its being wrapped about the plastic core wrap.

For this cable, it becomes necessary to provide waterproofing material for the seam and only the inner major surface of the core wrap. With some waterproofing materials, this is accomplished simply by wrapping the strip 76 of plastic material about the core which squeezes the core and causes waterproofing material to flow upwardly into the seam being formed. For other waterproofing materials, flow is not easily accomplished particularly when they engage the relatively cool strip 76 of plastic material. Therefore, it becomes necessary to provide a stipe of waterproofing material adjacent to one longitudinal edge of the plastic tape. This must be done without the application of waterproofing material to the outer surface of the tape. If not, the subsequently applied atactic material may become contaminated.

Figure 9:
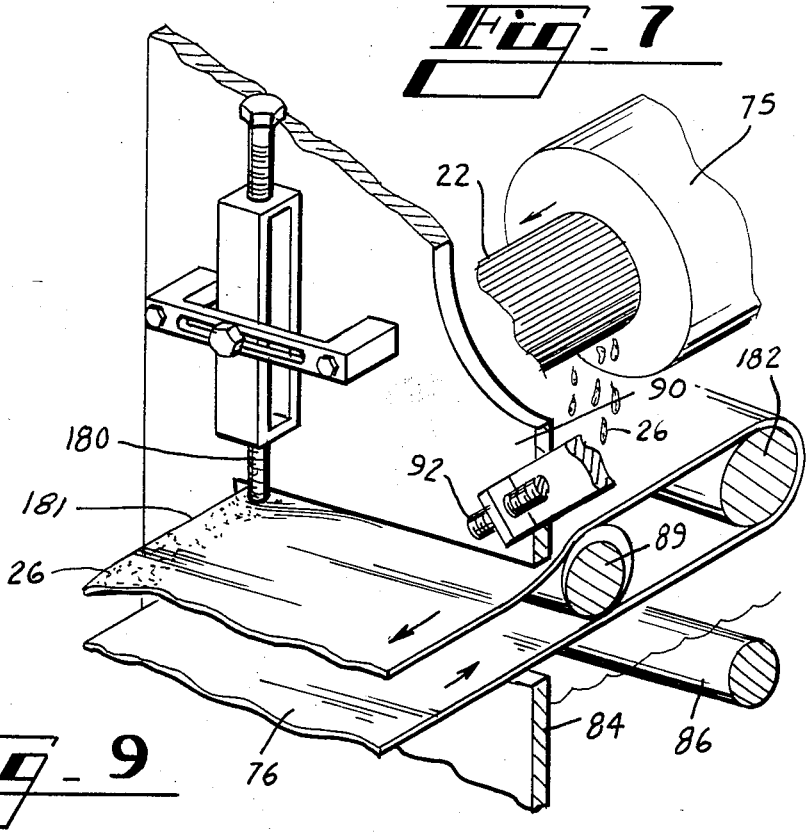
FIG. 9 is a perspective view of the apparatus shown in FIG. 4.

This is accomplished by providing a second adjustable rod 180 (see FIG. 5) outside the tank enclosure. The second adjustable rod 180 is positioned so that it can engage a longitudinal edge portion 181 of the strip 76 as the strip is advanced out of the tank (see FIG. 9). This allows the depending edge portion of the wall 90 to remove any material on the strip except for that along the longitudinal edge portion 181 thereof. In this embodiment, the first described rod 92 is positioned so as not to deflect the center portion of the strip 76.

Inasmuch as waterproofing material in this arrangement is not desired on the remainder of the major surfaces, the strip 76 is not advanced around the guide roller 86 but rather only past the grooved roller 89 and around a guide roller 182. This is done to allow sufficient drippings from the advancing core 22 to provide the supply of waterproofing material.

Figure 10:
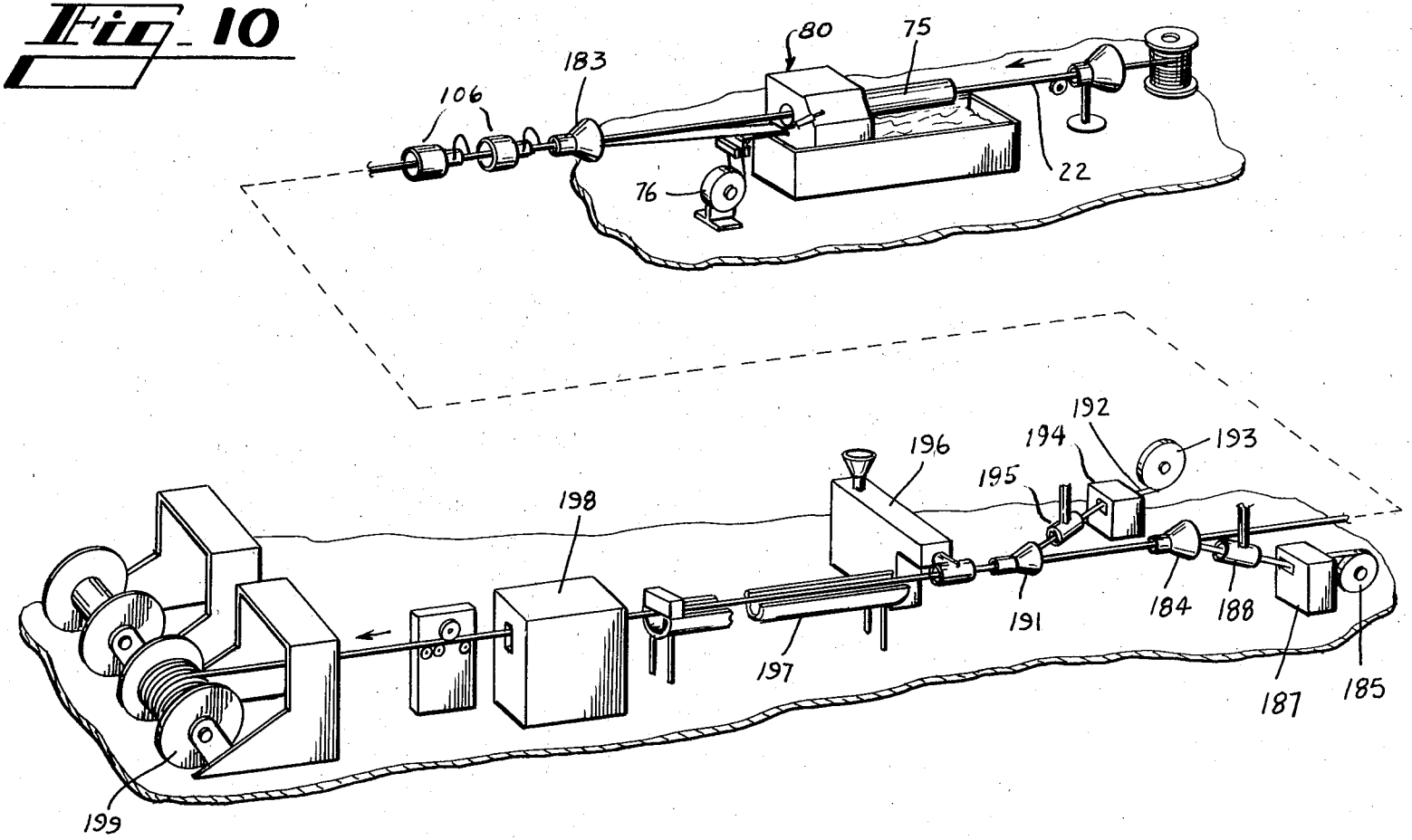
FIG. 10 is a schematic view of apparatus which includes the apparatus of FIG. 9 for making another cable.

The manufacture of the non-bonded cable then includes the wrapping of the strip of plastic material having a coated longitudinal edge portion about the advancing core in a former 183 (see FIG. 10). From there, the wrapped core 22 is bound by binders 106—106, and advanced through a former 184 wherein an aluminum tape 185 which has been corrugated in a device 187 and flooded in a chamber 188 is wrapped longitudinally about the core 22. Afterwards, the shielded core 22 is advanced through another former 191 wherein a steel tape 192 from a supply 193 which has been corrugated in a device 194 and flooded in an applicator 195, is formed into an outer shield about the already shielded core. Then the bishielded core is moved through an extruder 196 wherein a plastic jacket is formed and then through a cooling trough 197 and a capstan 198 to a take-up 199.

It is to be understood that the above-described arrangements are simply illustrative of the invention. Other arrangements may be devised by those skilled in the art which will embody the principles of the invention and fall within the spirit and scope thereof.

What is claimed is:

1. A method of enclosing a cable core with a strip of plastic material having a waterproofing material applied to at least one major surface thereof, said method including the steps of:

advancing a cable core along a path of travel;

advancing a strip of plastic material along a path which is juxtaposed to the path of the core;

causing a waterproofing material to be applied to at least one major surface of the strip;

Disposing a metering member transversely across the one major surface of the advancing strip;

holding a portion of the advancing strip spaced from the metering member to control the quantity and the distribution of the waterproofing material that remains on the one major surface of the strip as the strip is advanced past the metering member; and wrapping the strip about the advancing core to form a cover having a longitudinal overlapped seam with the quantity and distribution of waterproofing material remaining on the one major surface being sufficient to cause waterproofing material to become disposed in the seam.

2. The method of claim 1, wherein the portion of the strip is a longitudinal edge portion which is deflected out of engagement with the metering member.

3. The method of claim 1, wherein a center portion of the strip and portions of the strip on each side of the center portion are held out of engagement with the metering member.

4. The method of claim 1, wherein said step of causing includes advancing the strip of plastic material into and out of a tank which contains a waterproofing material in liquid phase to cause the waterproofing material to be applied to both major surfaces of the strip, and said step of holding includes engaging and deflecting at least a portion of the one major surface of the strip to control the distribution of the waterproofing material on the one major surface as the strip is advanced out of the tank past the metering member; and said method also includes:

engaging the other major surface of the strip to cause the waterproofing material thereon to become disposed in a plurality of longitudinally extending troughs and ridges.

5. The method of claim 4, wherein a corrugated metallic tape is wrapped about the strip of plastic material and the waterproofing material disposed in the longitudinally extending ridges is sufficient to fill the corrugations on the inwardly facing major surface of the metallic tape.

6. The method of claim 4, which also includes the step of adjusting the disposition of the strip with respect to the metering member to vary the quantity of waterproofing material on the strip which has been advanced out of the tank.

7. The method of claim 4, which also includes the step of adjusting the height of the ridges of waterproofing material on the other major surface of the strip.

8. The method of claim 4, wherein the strip is oriented with longitudinal edge surfaces which interconnect the major surfaces being disposed vertically and with the one major surface being disposed above the other major surface as the strip is advanced past the metering member.

9. A method of making a bonded sheath cable, said method comprising the steps of:

advancing a core comprising at least one conductor;

coating an outer and an inner surface of a strip of plastic material with a first waterproofing material;

controlling the quantity and the distribution of the first waterproofing material which is disposed on each major surface of the strip;

wrapping the strip of plastic material about the core to form a longitudinal overlapped seam;

wrapping a first corrugated metallic tape about the strip of plastic material to form an inner shield, the quantity and distribution of waterproofing material on the strip being sufficient to seal the seam of the plastic strip and to prevent substantially the formation of any voids between the plastic strip and the inner shield;

applying a second waterproofing material to the outer surface of the inner shield;

wrapping a second corrugated metallic tape having a surface thereof coated with an adhesive material about the first metallic tape to form an outer shield having a longitudinal overlapped seam and having the adhesive material facing outwardly;

introducing sufficient sealant material into the vicinity of the longitudinal edge portions of the second metallic tape as they are being overlapped to cause the sealant material to seal the overlapped seam of the outer shield and to fill any cavities between the outer shield and the inner shield in the vicinity of the overlapped seam of the outer shield; and extruding a plastic material about the outer shield to form a jacket and to cause the adhesive material on the outer surface of the shield to bond the jacket thereto.

10. An apparatus for enclosing a cable core with a strip of plastic material having a waterproofing material applied to at least one major surface thereof, said apparatus including:

means for advancing a cable core along a path of travel;

means for advancing a strip of plastic material along a path juxtaposed to the path of travel of the core;

means for causing a waterproofing material to be applied to at least one major surface of the strip of plastic material;

metering means for controlling the quantity and the distribution of the waterproofng material that remains on the one major surface of the strip as the strip is advanced past the metering means, said metering means including means disposed transversely across the one major surface of the advancing strip and adjustable means for holding at least a portion of the advancing strip out of engagement with said metering means; and forming means for wrapping the strip about the advancing core to form a longitudinal seam with the quantity and distribution of the waterproofing material remaining on the one major surface being sufficient to become disposed in the seam.

11. The apparatus of claim 10, wherein said adjustable means causes a longitudinal edge portion of the strip to be held out of engagement with said metering means.

12. The apparatus of claim 10, wherein said adjustable means causes a center portion and portions of the strip on each side of the center portion to be held out of engagement with said metering means.

13. The apparatus of claim 10, said apparatus including:

a tank for holding a liquid waterproofing material;

means for causing the strip to be advanced into and out of said tank to cause the waterproofing material to be applied to each major surface of the strip; and roller means for engaging the waterproofing material on the other major surface of the strip to cause the waterproofing material thereon to become disposed in a plurality of longitudinally extending troughs and ridges;

said metering means including a distribution surface for engaging the waterproofing material on the one major surface of the strip as the strip is advanced out of the tank, and rod-like means for causing at least a portion of the one major surface to be held out of engagement with said surface to control the quantity and the distribution of waterproofing material on the one major surface of the strip as the strip is advanced out of the tank.

14. The apparatus of claim 13, wherein said roller means and said surface are disposed to cause longitudinal edge surfaces which interconnect the major surfaces of the strip to be oriented vertically.

15. The apparatus of claim 14, wherein said roller means also includes means for adjusting the height of the ridges of the waterproofing material on the other major surface of the strip.

16. An apparatus for making a bonded sheath, filled cable, said apparatus comprising:

means for advancing a cable core filled with a first waterproofing material;

means for advancing a strip of plastic material;

means for causing the plastic strip to have a controlled amount and distribution of the first waterproofing material along each major surface thereof;

means for enclosing the core in the strip of plastic material, the waterproofing material on the strip being sufficient to seal the overlapped seam;

means for forming a first corrugated metallic tape into an inner shield about the plastic strip, the waterproofing material on the one major surface of the plastic strip being sufficient to fill the corrugations on the inwardly facing surface of the inner shield;

means for introducing a second waterproofing material in the vicinity of said means for forming the metallic shield for filling the outer corrugations of the inner shield;

forming means for causing a second metallic tape having a surface thereof coated with an adhesive material to be wrapped about the inner shield to form an outer shield having a longitudinal overlapped seam and having the adhesive material facing outwardly;

means for introducing a sealant material into the vicinity of the longitudinal edge portions of the second tape as they are being overlapped to cause the sealant material to seal said overlapped seam of the outer shield and to cause the sealant material to flow circumferentially of said core to fill any cavities between said outer shield; and means for extruding a jacket of plastic material about said outer shield and for causing said jacket to be bonded by said adhesive material to said outer shield.

* * * * *

UNITED STATES PATENT AND TRADEMARK OFFICE

CERTIFICATE OF CORRECTION

PATENT NO. : 4,595,431

DATED : June 17, 1986

INVENTOR(S) : W. D. Bohannon, Jr., A. S. Hamilton, D. E. West

It is certified that error appears in the above-identified patent and that said Letters Patent are hereby corrected as shown below:

In the claims, Column 14, claim 16, line 9, "outer shield; and" should read --outer shield and said inner shield in the vicinity of said overlapped seam of said outer shield; and--.

Signed and Sealed this

Eleventh Day of November, 1986

*Attest:*

DONALD J. QUIGG

*Attesting Officer*

*Commissioner of Patents and Trademarks*